US005811748A

United States Patent [19]

Manthe et al.

[11] Patent Number: 5,811,748

[45] Date of Patent: Sep. 22, 1998

[54] LOW-VOLTAGE POWER SWITCH WITH A SWITCHING CHAMBER

[75] Inventors: Karl-Heinz Manthe; Martin Böttcher; Sezai Türkmen, all of Berlin, Germany

[73] Assignee: Siemens Aktiengesellschaft, München, Germany

[21] Appl. No.: 727,517

[22] PCT Filed: Apr. 7, 1995

[86] PCT No.: PCT/DE95/00483

§ 371 Date: Mar. 7, 1997

§ 102(e) Date: Mar. 7, 1997

[87] PCT Pub. No.: WO95/28726

PCT Pub. Date: Oct. 26, 1995

[30] Foreign Application Priority Data

Apr. 19, 1994 [DE] Germany ..... 44 16 105.0

[51] Int. Cl.[6] ..... H01H 9/30; H01H 73/18

[52] U.S. Cl. ..... 218/155; 218/157

[58] Field of Search ..... 218/15–40, 90, 218/91, 155–158, 146–147, 149–151

[56] References Cited

U.S. PATENT DOCUMENTS

| | | | |
|---|---|---|---|
| 2,854,555 | 9/1958 | Ednunds | 200/308 |
| 4,764,650 | 8/1988 | Bur et al. | 218/157 X |

FOREIGN PATENT DOCUMENTS

| | | | |
|---|---|---|---|
| 0 225 207 | 10/1986 | European Pat. Off. | H01H 71/02 |
| 0 437 151 | 11/1990 | European Pat. Off. | H01H 9/34 |
| 1 021 054 | 12/1957 | Germany . | |
| 1 257 933 | 7/1968 | Germany | H01H 73/18 |

*Primary Examiner*—J. R. Scott
*Attorney, Agent, or Firm*—Kenyon & Kenyon

[57] ABSTRACT

A low-voltage power switch having a switching chamber with a switching contact arrangement and an arc extinguishing device. Sealing of the switching chamber is achieved by an apron-like projection on the movable contact support in combination with a stationary curved recess and by ribs opposite the movable contact support and a sealing arrangement on the stationary counter-contact.

10 Claims, 2 Drawing Sheets

LOW-VOLTAGE POWER SWITCH WITH A SWITCHING CHAMBER

FIELD OF THE INVENTION

The present invention relates to a low-voltage power switch with a switching chamber and a switching contact arrangement in the switching chamber and with an arc extinguishing device.

BACKGROUND INFORMATION

A low-voltage power switch is described in European Patent Application No. 0 437 151, where interaction of the curved lateral surface with the stationary rib limits the passage of switching gases in the direction of the drive parts that are upstream from the switching contact arrangement and that are connected to the contact support with an articulated joint. Furthermore, the space upstream from the switching contact arrangement contains additional sensitive electromechanical and electronic components that must be protected from exposure to switching gases.

However, as a preferred flow path is imparted to the switching gases, the pressure of the switching gases in the remaining directions increases to the same extent. This is desirable inasmuch as it results in a propulsive force acting on the arc traveling between the arc splitters of the arc extinguisher after the arc is ignited between the separating contacts. In this connection, the propagation of the pressure wave emanating from the arc in an unwanted direction is advantageous due to a design of the switching space provided for the contacts below the extinguishing space so that the contacts and the parts connected to them are closely surrounded by the chamber walls at the side and on the end facing away from the extinguishing space in such a way that the only possibility of expansion is in the direction of the arc extinguishing chamber as described in German Patent Application No 1 021 054. Apart from the problem of creating an arrangement with these properties that conforms to practical requirements and is not complicated to manufacture, another problem is that with large power switches the arc extinguishing chamber can be manufactured only as a separate unit, and when connecting it to the main body of the power switch, there is also the problem of sealing the gap and joints from the technical point of view to prevent the passage of ionized switching gases and especially to prevent electric arcing due to gases that escape nevertheless.

SUMMARY OF THE INVENTION

The present invention provides for a low-power switch with a switching chamber and a switching contact arrangement in the switching chamber and with an arc extinguishing device, where the switching contact arrangement has an insulating contact support that is mounted so it can pivot relative to a stationary counter-contact, and where the contact support has a lateral surface that is approximately concentric with the bearing and is a slight distance opposite a stationary rib.

According to the present invention, a low-voltage power switch with an increased switching capacity and improved electrical safety includes a contact support that has an apron-like projection below the contacts on its side facing the stationary counter-contact and a matching recess in a wall of the switching chamber to A first rib is provided at a distance from the second rib forming an eddy chamber. The power switch also includes a extinguishing device on the switching chamber that is provided between the rear of the switching contact arrangement and the arc extinguishing device.

When used together, these features solve the problem of guiding the switching gases, because the pressure of the switching gases acts predominantly in the direction of the arc extinguishing chamber and therefore the movement of the arc between the arc splitters is accelerated. The amount of switching gases escaping into the other areas of the power switch is thus accordingly low, and therefore the negative effect on the electric properties is also reduced.

With power switches of a compact design, described for example, in U.S. Pat. No. A 2,854,555, an operating handle may be provided with a curved shield mounted facing the ribs on the inside of the housing cover. When a distance that is required for mechanical reasons is maintained, the arrangements of U.S. Pat. No. 2,854,555 yields a certain sealing effect against switching gases that could endanger an operating person due to the temperature of the arrangement. Not only a certain temperature but also adequate deionization is important.

The sealing arrangement can be formed by a wall of the arc extinguishing device that tightly covers the connection strip. For larger arc extinguishing devices, it is suitable to use a separate sealing shield made of an insulating material to bridge the space between a wall of the arc extinguishing device and the connection strip.

The apron-like projection mentioned above may be designed to correspond approximately to the contact travel distance, and the engagement between the projection and the respective recess may be designed so that it is terminated when there is a full opening of the contact. Consequently, the projection acts mainly as a sealing element, and a certain cross section passage is formed only when there is a full opening of the contact so air can flow through the passage toward the end of the extinguishing process. By designing the engagement dimensions, the valve action described here can be implemented.

To achieve a good seal below the contact arrangement, it is preferable to design the recess so it is curved with regard to the bearing of the contact support. The practical aspects such as the ease of manufacturing and assembly of parts constitute an important aspect in the construction of low-voltage power switches. In this regard, it is advantageous if the sealing shield in one embodiment of the present invention is designed so it can be deformed in the direction of the wall part under the pressure of the switching gases and the overlap is designed in steps or has inclined faces.

Furthermore, the ribs that work together with the curved lateral surface of the contact support can be arranged at an angle to each other and are designed with approximately the same length and with a curved continuous transition from one to the other. This design yields a surprisingly good seal, although the requirements regarding the distance to be maintained between the lateral surface and the ribs are easily fulfilled. In Another Embodiment of the present invention two ribs may be part of a wall of the arc extinguishing chamber.

The insulation of adjacent poles relative to each other can be improved by the housing of the arc extinguishing device having edge segments extending around the sealing shield at the sides.

DETAILED DESCRIPTION

Figure 1:
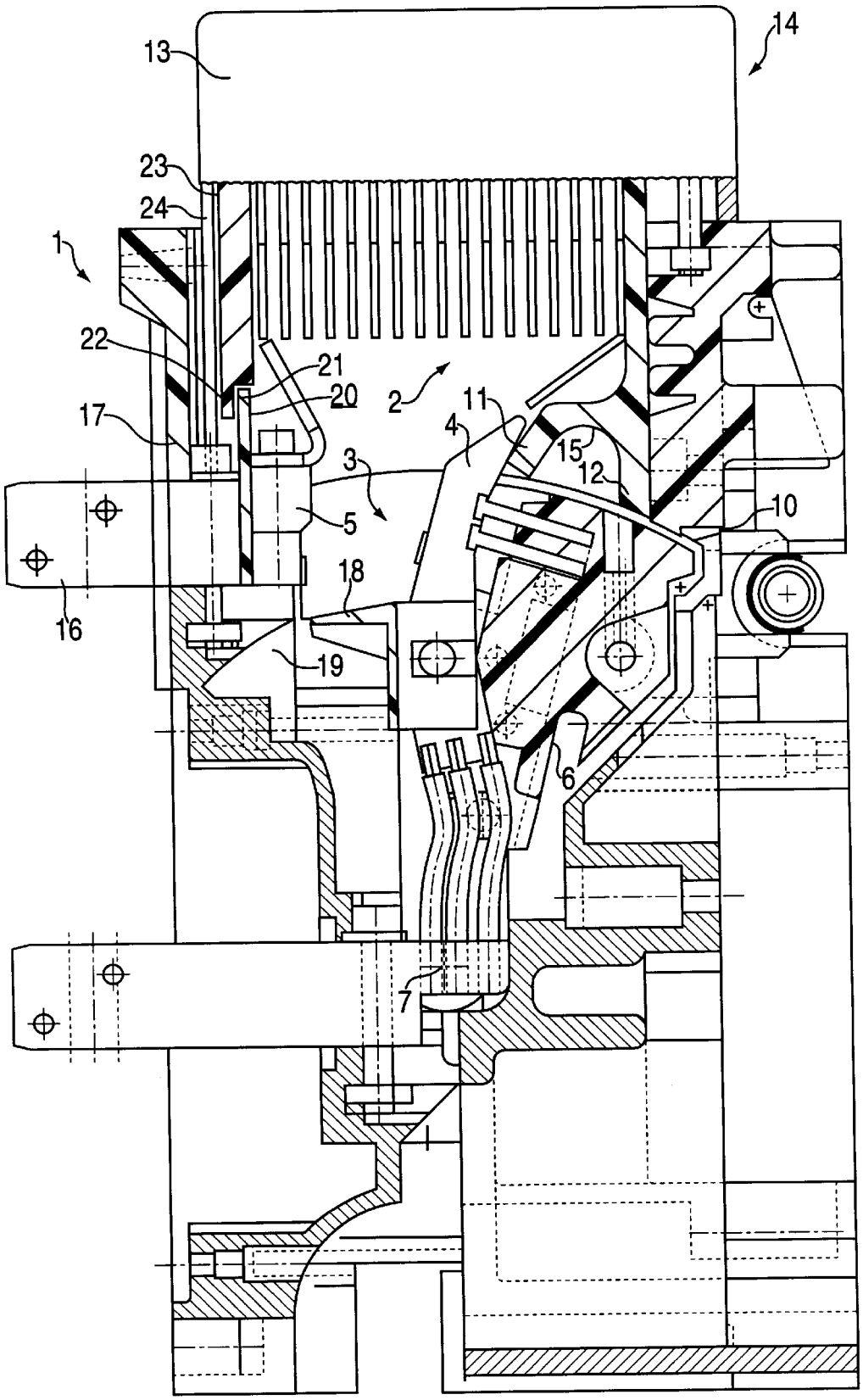
FIG. 1 shows a sectional view of a pole of a low-voltage multi-pole power switch. According to the present invention.

Low-voltage power switch 1 illustrated in FIG. 1 has a switching chamber 2 with a switching contact arrangement inside it, comprising one or more movable contact levers 4 per pole and a stationary counter-contact 5 that works together with the one or more contact levers 4. Contact lever 4 is spring mounted on an insulating contact support 6 that can pivot about a bearing 7 that is not illustrated in detail. A curved lateral surface 10 of contact support 6 that is aligned with bearing 7 is opposite two ribs 11 and 12 at a slight distance, where ribs 11 and 12 are part of housing 13 of arc extinguishing device 14. Ribs 11 and 12 are angled with respect to each other with a smooth transition between them having an substantially cylindrical transitional surface 15.

Stationary counter-contact 5 is mounted on a connection strip 16 that projects out of housing 17 of power switch 1. Directly below the interacting contacts, movable contact support 6 is provided with an apron-like projection 18 that works together with a recess 19 that is also aligned with bearing 7 and has a curved border at its top in housing 17 of power switch 1. As FIG. 1 shows, there is only a slight space between the front edge of projection 18 and recess 19 in the completely opened contact arrangement, so projection 18 remains engaged with recess 19 during substantially the entire switching operation.

Additional measures to increase imperviousness are provided in the area above and behind stationary counter-contact 5, where sealing shield 20 extends beyond connection strip 16. Top edge 21 faces a stepped end edge 22 of a wall part 23 of arc extinguishing device 14 at a slight distance. The deformability of sealing shield 20 ensures that top edges 21 are in contact with end edges 22 under the pressure of the switching gas in switching space 2, which can thus prevent the passage of switching gases.

Figure 2:
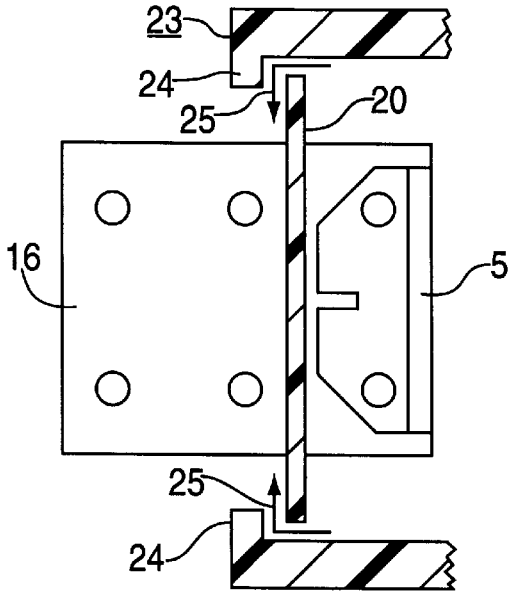
FIG. 2 shows a detail in the area of a stationary switching contact and adjacent parts of an arc extinguishing chamber.

However, certain gaps must remain at the side of sealing shield 20 for reasons concerning the assembly of arc extinguishing chamber 14. However, these gaps are bridged according to FIG. 2 by side angles 24 of housing 13 of arc extinguishing chamber 14, so that, as indicated by arrows 25 in FIG. 2, the switching gases that pass through are deflected and thus are prevented from striking voltage-carrying parts of an adjacent pole of power switch 1.

Figure 3:
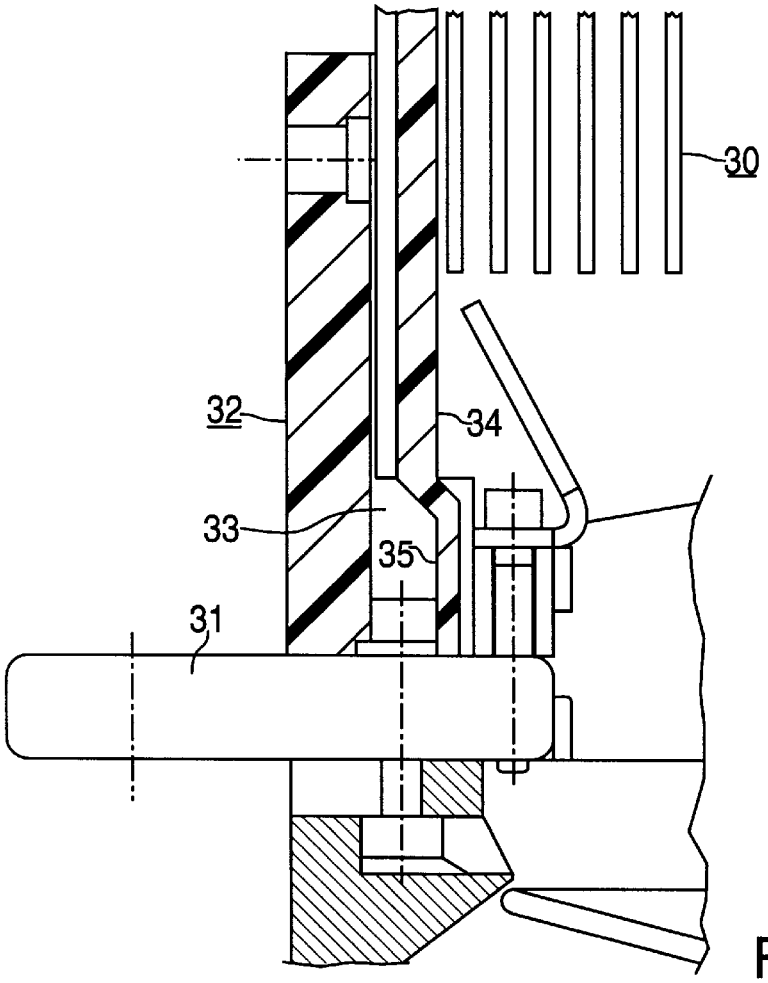
FIG. 3 shows a detail of a sealing arrangement in the area of a connection strip.

FIG. 3 shows a detail of the area, where an arc extinguishing device 30 is sealed with respect to a connection strip 31. A wall 34 of arc extinguishing device 30 sits on a pedestal-like projection 33 mounted on chamber housing 32. Wall 34 has legs 35 that reach beyond projection 33 on both sides and it extends down to connection strip 31. This seals off all gaps when arc extinguishing device 30 is mounted on the chamber housing.

What is claimed is:

1. A low-voltage power switch including a switching chamber, comprising:

an arc extinguishing device including a housing, a first rib and a second rib, the second rib positioned at a first distance from the first rib to form an eddy chamber, the housing including a recess;

a switching contact arrangement positioned in the switching chamber, the switching chamber including an insulating movable contact carrier member and a stationary counter contact member, the movable contact carrier member being mounted on a pivotal bearing inside the switching chamber for moving the movable contact carrier member relative to the stationary counter contact member, the movable counter carrier member including an end surface positioned substantially concentric to the pivotal bearing, the end surface being positioned opposite to the first rib at a second distance, the movable contact carrier member further including an apron-like projection extending below the switching contact arrangement, the projection being situated on a first side of the movable contact carrier member proximal to the stationary counter contact member for substantially matching the recess in the housing; and a sealing arrangement formed between a rear portion of the switching contact arrangement and the arc extinguishing device, the sealing arrangement being formed by placing the arc extinguishing device over the switching chamber.

2. The low-voltage power switch according to claim 1, wherein the sealing arrangement includes a wall part of the arc extinguishing device, the wall part tightly covering a connecting conductor supporting the stationary counter contact member.

3. The low-voltage power switch according to claim 1, wherein the sealing arrangement includes:

a connecting conductor supporting the stationary counter contact member; and a sealing shield composed of insulating material at least partly surrounding the connecting conductor, the sealing shield including an overlap portion overlapping a wall part of the arc extinguishing device.

4. The low-voltage power switch according to claim 3, wherein the sealing shield is deformable toward the wall part under a switching gas pressure, the overlap portion having at least one of a stepped surface and an inclined surface.

5. The low-voltage power switch according to claim 4, wherein the housing of the arc extinguishing device includes edge projections laterally overlapping the sealing shield.

6. The low-voltage power switch according to claim 3, wherein the housing of the arc extinguishing device includes edge projections laterally overlapping the sealing shield.

7. The low-voltage power switch according to claim 1, wherein the apron-like projection is dimensioned to substantially correspond to a contact travel distance of the movable contact carrier member, and wherein the apron-like projection overlaps the recess when the switching contact arrangement is fully open.

8. The low-voltage power switch according to claim 7, wherein the recess includes a curved border having a center for providing the pivotal bearing of the movable contact carrier member.

9. The low-voltage power switch according to claim 1, further comprising:

a curved transitional surface formed between the first and second ribs, wherein the first rib has a first length, and the second rib has a second length, the first length being substantially equal to the second length, the first rib arranged at a predetermined angle relative to the second rib.

10. The low-voltage power switch according to claim 9, wherein the first and second ribs are positioned in the housing of the arc extinguishing device.

* * * * *